US005568663A

United States Patent [19]

Brown

[11] Patent Number: 5,568,663

[45] Date of Patent: Oct. 29, 1996

[54] DISPOSABLE RESCUE MATTRESS

[76] Inventor: David T. Brown, 18 The Meadows, Gillingham, Dorset, England

[21] Appl. No.: 502,477

[22] Filed: Jul. 14, 1995

[51] Int. Cl.[6] ..... A47C 27/08; A61G 1/00

[52] U.S. Cl. ..... 5/628; 5/627; 5/413 AM; 5/706

[58] Field of Search ..... 5/466, 455, 456, 5/457, 625, 627, 628, 413, 413 AM

[56] References Cited

U.S. PATENT DOCUMENTS

| | | | |
|---|---|---|---|
| 802,526 | 10/1905 | Russell, Jr. | 5/457 |
| 867,464 | 10/1907 | Abbott | 5/413 |
| 2,542,781 | 2/1951 | Sawyer | 5/457 |
| 3,775,782 | 12/1973 | Rice et al. | 5/25 |
| 4,067,075 | 1/1978 | Leathers et al. | 5/625 |
| 4,092,750 | 6/1978 | Ellis | 5/413 |
| 4,736,474 | 4/1988 | Moran et al. | 5/627 |

FOREIGN PATENT DOCUMENTS

| | | | |
|---|---|---|---|
| 2261605 | 5/1993 | United Kingdom | 5/627 |

*Primary Examiner*—Michael F. Trettel

[57] ABSTRACT

A disposable rescue mattress comprised of a mattress being comprised of an upper sheet and a lower sheet. The upper sheet and lower sheet are secured together along peripheral edges thereof to form an upper edge, a lower edge, and two side edges. The lower edge has an air intake valve extending therethrough into the inner surface of the mattress. The device also includes a blanket having an upper edge, a lower edge, and two side edges. The lower edge and two side edges are secured to the corresponding lower edge and two side edges of the mattress with the upper edge extending upwardly beyond the upper edge of the mattress.

5 Claims, 4 Drawing Sheets

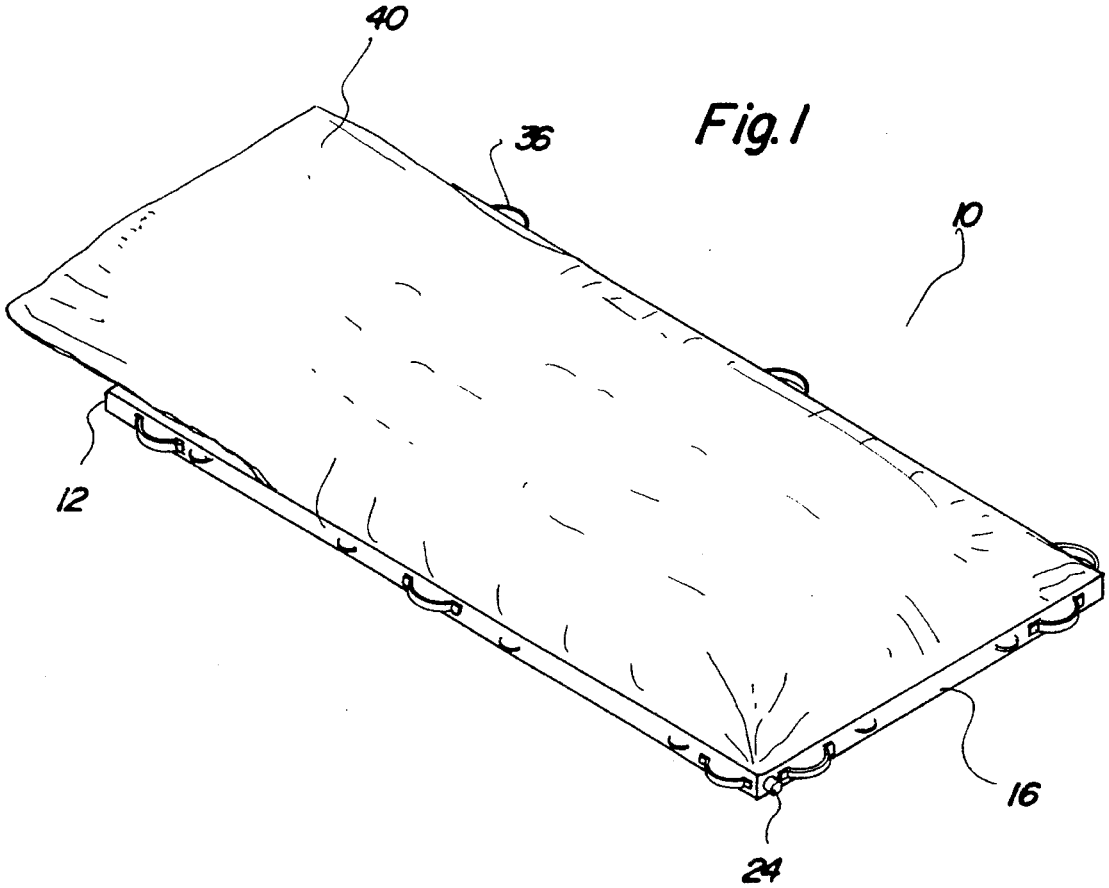
Fig. 1
Fig. 2
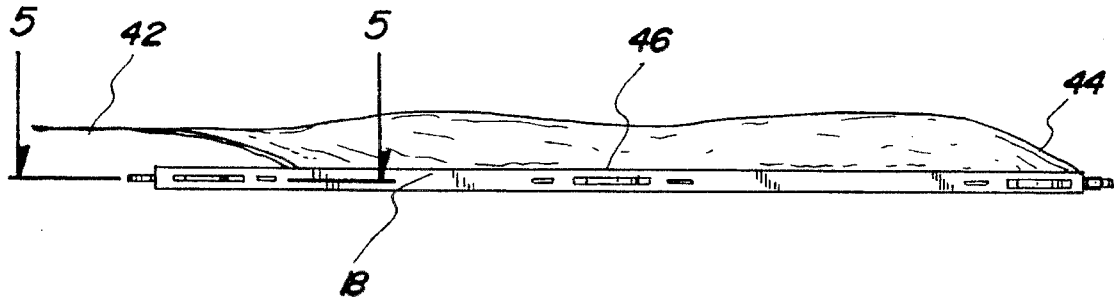

DISPOSABLE RESCUE MATTRESS

BACKGROUND OF THE INVENTION

1. Field of the Invention

The present invention relates to a disposable rescue mattress and more particularly pertains to providing stable support and insulation from a ground area for an injured person with a disposable rescue mattress.

2. Description of the Prior Art

The use of emergency treatment equipment is known in the prior art. More specifically, emergency treatment equipment heretofore devised and utilized for the purpose of aiding in the treatment of injured people are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,283,916 to Haro discloses a process for transporting injured or stranded people, and protective capsule for carrying out the process.

U.S. Pat. No. 5,153,958 to Okajima discloses a vibration-proof stretcher for emergency treatment.

U.S. Pat. No. Des. 266,470 to Gammons et al. discloses the ornamental design for a patient treatment mattress with inflatable channels.

U.S. Pat. No. 4,067,075 to Leathers et al. discloses an inflatable stretcher.

U.S. Pat. No. 3,775,782 to Rice et al. discloses an inflatable aquatic rescue board and method of rescue.

U.S. Pat. No. 3,056,980 to Holladay discloses a plastic sheeting articles and manufacture.

While these devices fulfill their respective, particular objective and requirements, the aforementioned patents do not describe a disposable rescue mattress for providing stable support and insulation from a ground area for an injured person.

In this respect, the disposable rescue mattress according to the present invention substantially departs from the conventional concepts and designs of the prior art, and in doing so provides an apparatus primarily developed for the purpose of providing stable support and insulation from a ground area for an injured person.

Therefore, it can be appreciated that there exists a continuing need for new and improved disposable rescue mattress which can be used for providing stable support and insulation from a ground area for an injured person. In this regard, the present invention substantially fulfills this need.

SUMMARY OF THE INVENTION

In the view of the foregoing disadvantages inherent in the known types of emergency treatment equipment now present in the prior art, the present invention provides an improved disposable rescue mattress. As such, the general purpose of the present invention, which will be described subsequently in greater detail, is to provide a new and improved disposable rescue mattress and method which has all the advantages of the prior art and none of the disadvantages.

To attain this, the present invention essentially comprises a mattress having a generally rectangular configuration. The mattress is comprised of an upper sheet and a lower sheet. The upper sheet and lower sheet are secured together along peripheral edges thereof to form an upper edge, a lower edge, and two side edges. The mattress has a plurality of transverse links extending horizontally and vertically within an inner surface thereof. The plurality of transverse links have a plurality of perforations formed therein. The lower edge has an air intake valve extending therethrough into the inner surface of the mattress. Each of the two side edges has three handles secured thereto. The upper edge and the lower edge each have two handles secured thereto. The device contains a blanket having a generally rectangular configuration. The blanket has an upper edge, a lower edge, and two side edges. The lower edge and two side edges are secured to the corresponding lower edge and two side edges of the mattress with the upper edge extending upwardly beyond the upper edge of the mattress.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved disposable rescue mattress which has all the advantages of the prior art emergency treatment equipment and none of the disadvantages.

It is another object of the present invention to provide a new and improved disposable rescue mattress which may be easily and efficiently manufactured and marketed.

It is a further object of the present invention to provide a new and improved disposable rescue mattress which is of durable and reliable construction.

An even further object of the present invention is to provide a new and improved disposable rescue mattress which is susceptible of a low cost of manufacture with regard to both materials and labor, and which accordingly is then susceptible of low prices of sale to the consuming public, thereby making such a disposable rescue mattress economically available to the buying public.

Still yet another object of the present invention is to provide a new and improved disposable rescue mattress which provides in the apparatuses and methods of the prior art some of the advantages thereof, while simultaneously overcoming some of the disadvantages normally associated therewith.

Even still another object of the present invention is to provide a new and improved disposable rescue mattress for providing stable support and insulation from a ground area for an injured person.

Lastly, it is an object of the present invention to provide a new and improved disposable rescue mattress comprised of a mattress being comprised of an upper sheet and a lower sheet. The upper sheet and lower sheet are secured together along peripheral edges thereof to form an upper edge, a lower edge, and two side edges. The lower edge has an air intake valve extending therethrough into the inner surface of the mattress. The device also includes a blanket having an upper edge, a lower edge, and two side edges. The lower edge and two side edges are secured to the corresponding lower edge and two side edges of the mattress with the upper edge extending upwardly beyond the upper edge of the mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the disposable rescue mattress constructed in accordance with the principles of the present invention.

FIG. 2 is a side elevation view of the present invention.

The same reference numerals refer to the same parts through the various Figures.

DESCRIPTION OF THE PREFERRED EMBODIMENT

Figure 3:
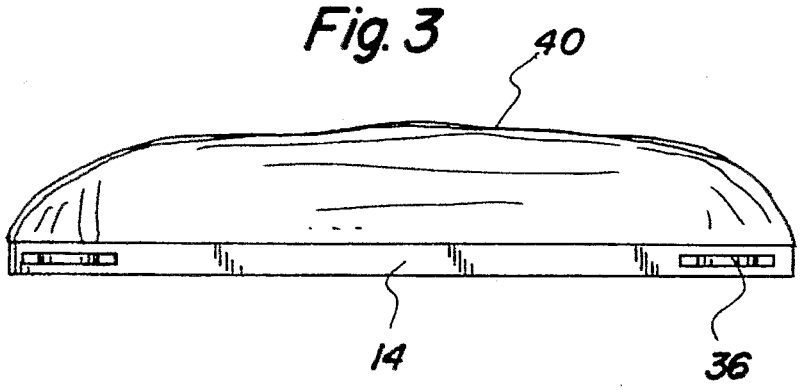
FIG. 3 is a front elevation view of the present invention.
Figure 4:
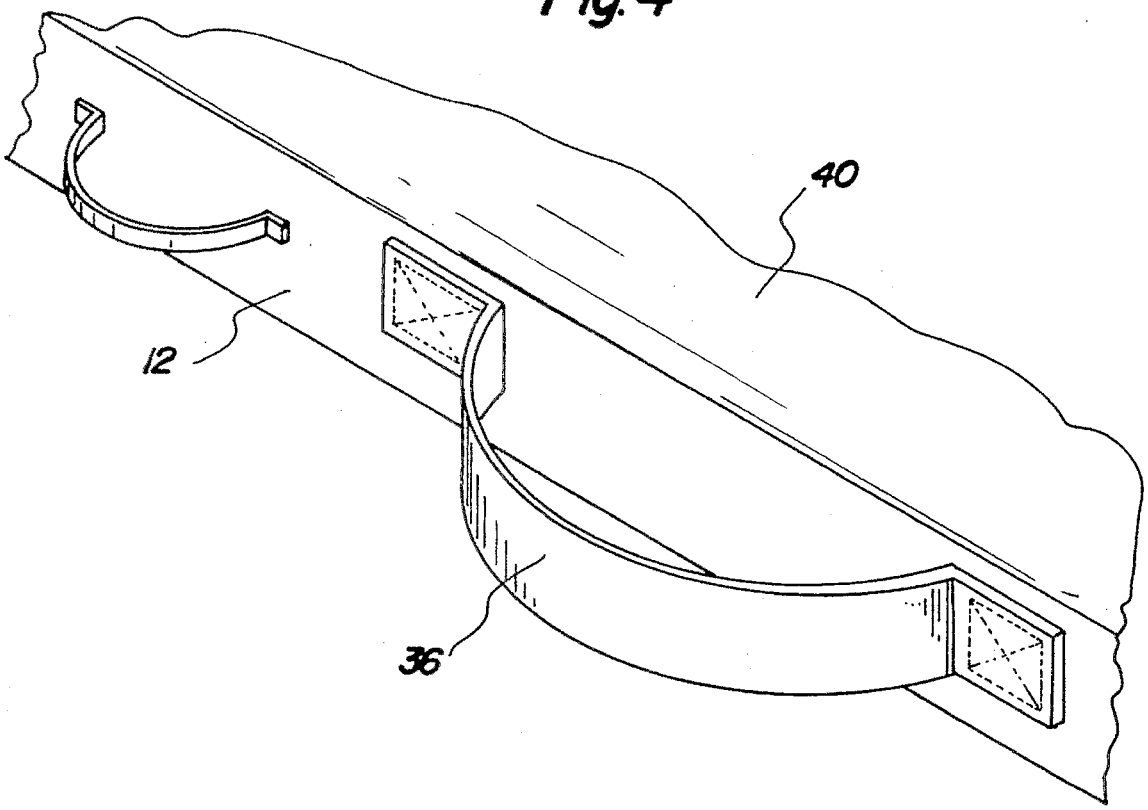
FIG. 4 is a perspective view of the carrying handles of the present invention.
Figure 5:
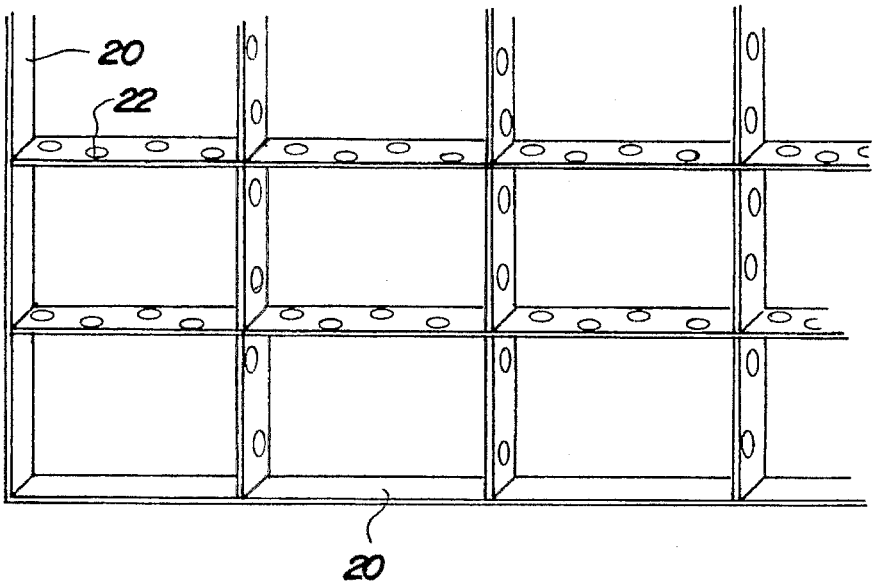
FIG. 5 is a cross-sectional view as taken along line 5—5 of FIG. 2.
Figure 6:
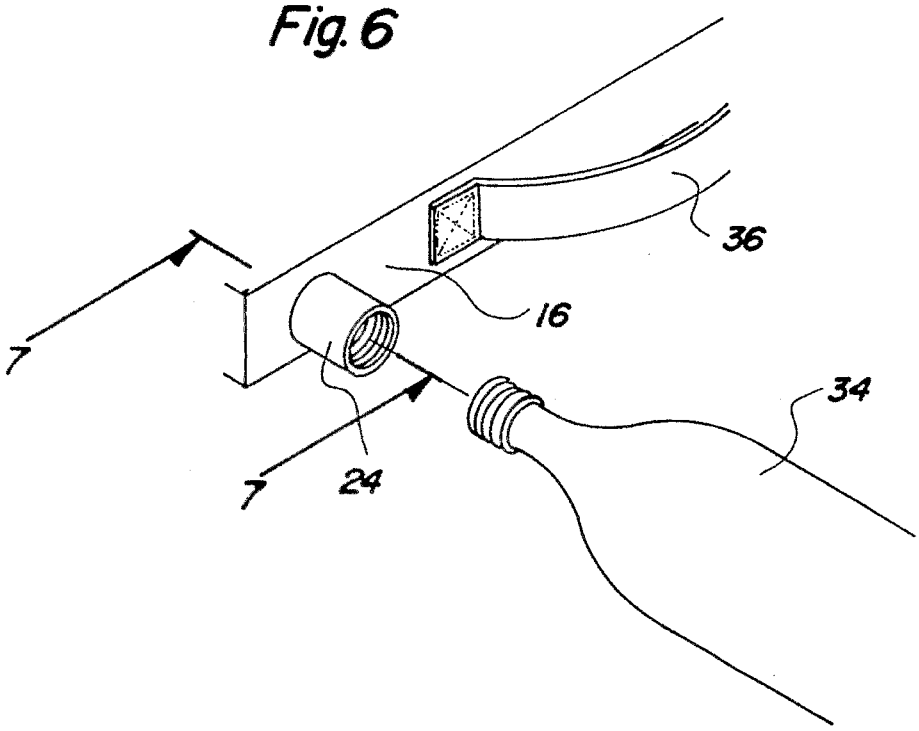
FIG. 6 is a perspective view of the valve intake of the present invention.
Figure 7:
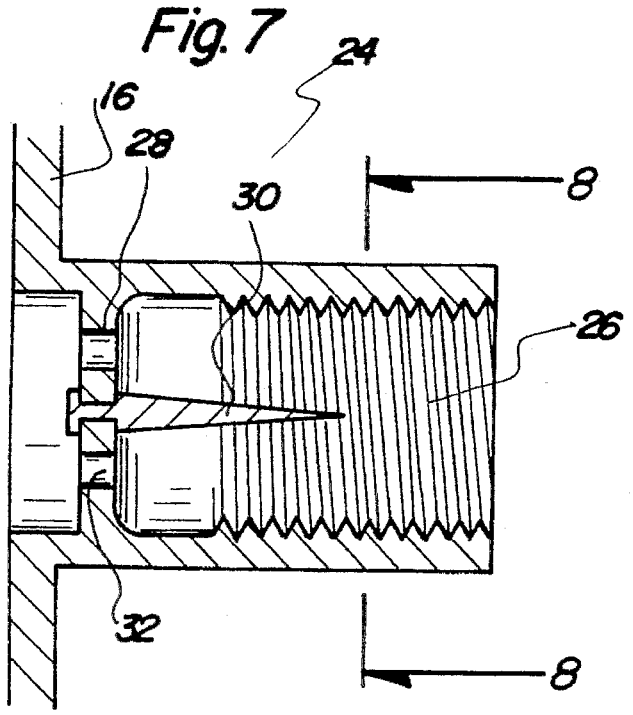
FIG. 7 is a cross-sectional view as taken along line 7—7 of FIG. 6.
Figure 8:
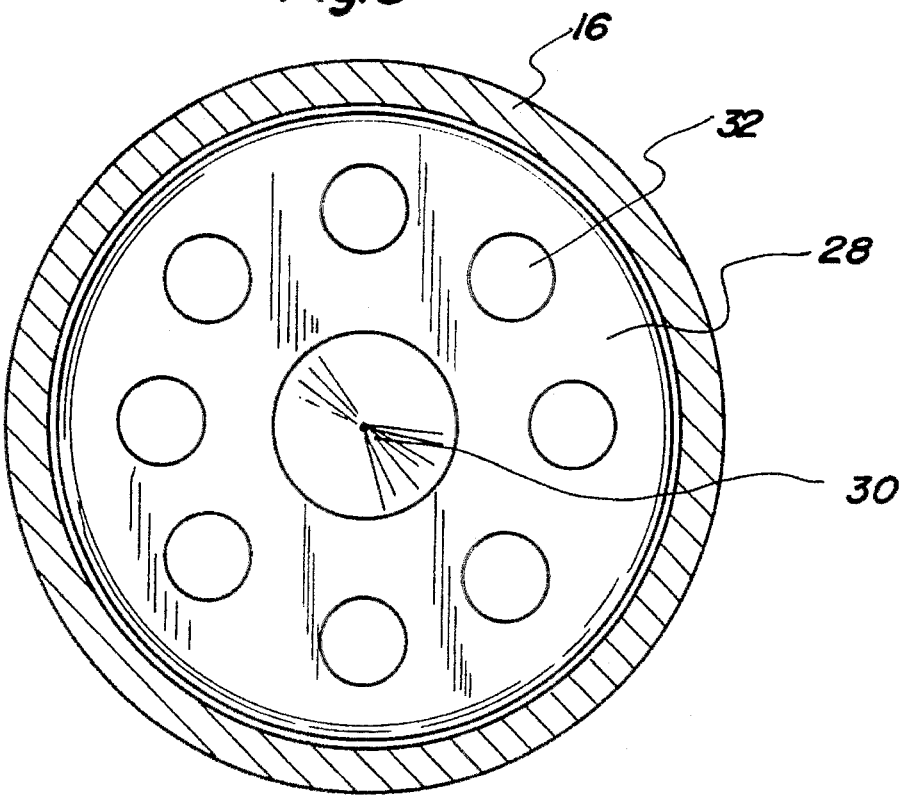
FIG. 8 is a cross-sectional view as taken along line 8—8 of FIG. 7.

With reference now to the drawings, and in particular, to FIG. 1 thereof, the preferred embodiment of the new and improved disposable rescue mattress embodying the principles and concepts of the present invention and generally designated by the reference number 10 will be described.

Specifically, it will be noted in the various Figures that the device relates to a new and improved disposable rescue mattress for providing stable support and insulation from a ground area for an injured person. In its broadest context, the device consists of a mattress and a blanket. Such components are individually configured and correlated with respect to each other so as to attain the desired objective.

The first component of the device 10 is a mattress 12. The mattress 12 has a generally rectangular configuration. The mattress 12 is comprised of an upper sheet and a lower sheet. The upper sheet and lower sheet are secured together along peripheral edges thereof to form an upper edge 14, a lower edge 16, and two side edges 18. The upper sheet and the lower sheet are constructed of sheets of thin, strong, but highly flexible plastic material. The peripheral edges are connected to each other by strips of material in a way which limits the direction and extent of the movement of the sheets and thus forces the mattress 12 to assume a flat shape when inflated. The mattress 12 has a plurality of transverse links 20 extending horizontally and vertically within an inner surface thereof. The plurality of transverse links 20 have a plurality of perforations 22 formed therein. The plurality of perforations 22 allow air to be able to circulate throughout the inner surface of the mattress 12 thereby preventing any inhibitors. The lower edge 16 has an air intake valve 24 extending therethrough into the inner surface of the mattress 12. The air intake valve 24 further comprises an internally threaded cylindrical stem 26 protruding outwardly of the lower edge 16 of the mattress 12. The stem 26 terminates at a wall 28 within the lower edge 16 of the mattress 12. The wall 28 has a needle 30 extending therethrough into the stem 26. The wall 28 has a plurality of apertures 32 formed therethrough leading into the inner surface of the mattress 12. The internally threaded cylindrical stem 26 is adapted for the receipt of a bottle of gas 34 therein. The gas bottle 34 has a mixture of carbon dioxide therein. The carbon dioxide functions to inflate the mattress 12. The gas bottle 34 is simply screwed into the internally threaded cylindrical stem 26 where the needle 30 will puncture a seal within the gas bottle 34 thereby allowing the carbon dioxide or other suitable mixture to permeate through the plurality of apertures 32 and into the inner surface of the mattress 12 causing the mattress to inflate. Once the inflation is complete an accompanying plug is used to prevent the carbon dioxide from exiting the mattress 12. Each of the two side edges 18 has three handles 36 secured thereto. The upper edge 14 and the lower edge 16 each have two handles 36 secured thereto. The handles 36 can be used to move an injured person to a safe place if necessary.

The second and final component of the device 10 is a blanket 40. The blanket 40 has a generally rectangular configuration. The blanket 40 is constructed of a highly visible material such as red, orange, or some other similar bright and reflective color. The blanket 40 has an upper edge 42, a lower edge 44, and two side edges 46. The lower edge 44 and two side edges 46 are secured to the corresponding lower edge 16 and two side edges 18 of the mattress 12 with the upper edge 42 extending upwardly beyond the upper edge 14 of the mattress 12. The blanket 40 would be of sufficient volume to accept a fully clothed and booted adult. The injured person is placed with their feet under the blanket 40. The mattress 12 is then gently pulled under the injured person until their body is covered by the blanket 40. The upper edge 42 of the blanket 40 is then wrapped around the injured persons head and neck to prevent hypothermia. After these steps have been accomplished, the mattress 12 is then inflated. When additional help arrives, the mattress 12 and the injured person can be lifted with the handles 36 and placed directly into a stretcher without having to transfer the injured person. When finished, the mattress 12 can be deflated by removing the plug from the air intake valve 24 or simply punctured with a knife.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A disposable rescue mattress for providing stable support and insulation from a ground area for an injured person comprising, in combination:

a mattress being comprised of an upper sheet and a lower sheet, the upper sheet and lower sheet being secured together along peripheral edges thereof to form an upper edge, a lower edge, and two side edges, the lower edge having an air intake valve extending therethrough into the inner surface of the mattress, the air intake valve further comprising an internally threaded cylindrical stem protruding outwardly of the lower edge of the mattress, the stem terminating at a wall within the lower edge of the mattress, the wall having a needle extending therethrough into the stem, the wall having a plurality of apertures formed therethrough leading into the inner surface of the mattress, the internally threaded cylindrical stem being adapted for the receipt of a bottle of gas therein;

a blanket having an upper edge, a lower edge, and two side edges, the lower edge and two side edges secured to the corresponding lower edge and two side edges of the mattress with the upper edge extending upwardly beyond the upper edge of the mattress.

2. The mattress as described in claim 1 and further including a plurality of transverse links extending horizontally and vertically within an inner surface of the mattress, the plurality of transverse links having a plurality of perforations formed therein.

3. The mattress as described in claim 1 and further including each of the two side edges of the mattress having three handles secured thereto, the upper edge and the lower edge of the mattress each having two handles secured thereto.

4. A disposable rescue mattress for providing stable support and insulation from a ground area for an injured person comprising, in combination:

a mattress having a generally rectangular configuration, the mattress being comprised of an upper sheet and a lower sheet, the upper sheet and lower sheet being secured together along peripheral edges there of to form an upper edge, a lower edge, and two side edges, the mattress having a plurality of transverse links extending horizontally and vertically within an inner surface thereof, the plurality of transverse links having a plurality of perforations formed therein, the lower edge having an air intake valve extending therethrough into the inner surface of the mattress, each of the two side edges having three handles secured thereto, the upper edge and the lower edge each having two handles secured thereto;

a blanket having a generally rectangular configuration, the blanket having an upper edge, a lower edge, and two side edges, the lower edge and two side edges secured to the corresponding lower edge and two side edges of the mattress with the upper edge extending upwardly beyond the upper edge of the mattress;

the air intake valve further comprising an internally threaded cylindrical stem protruding outwardly of the lower edge of the mattress, the stem terminating at a wall within the lower edge of the mattress, the wall having a needle extending therethrough into the stem, the wall having a plurality of apertures formed therethrough leading into the inner surface of the mattress, the internally threaded cylindrical stem being adapted for the receipt of a bottle of gas therein.

5. The mattress as described in claim 4 and further including a gas bottle, the gas bottle having a mixture of carbon dioxide therein, the carbon dioxide functioning to inflate the mattress.

* * * * *